US006070293A

United States Patent [19]

Schreiber

[11] Patent Number: 6,070,293

[45] Date of Patent: Jun. 6, 2000

[54] LATCHING HINGED COVER

[75] Inventor: Jacob Schreiber, Ra'anana, Israel

[73] Assignee: ECI Telecom, Ltd., Pertach Tikva, Israel

[21] Appl. No.: 09/152,141

[22] Filed: Sep. 11, 1998

[51] Int. Cl.[7] ..... E05D 1/70

[52] U.S. Cl. ..... 16/229; 16/261; 16/386

[58] Field of Search ..... 16/229, 230, 261, 16/257, 258, 259, 268, 265, 386, 224

[56] References Cited

U.S. PATENT DOCUMENTS

| | | | |
|---|---|---|---|
| 317,460 | 5/1885 | Joyner | 16/268 |
| 698,216 | 4/1902 | Newman | 16/229 |
| 1,024,837 | 4/1912 | Dupuis | 16/229 |
| 1,564,668 | 12/1925 | Hageman | 16/229 |
| 2,186,789 | 1/1940 | Rosenberg | 16/229 |
| 4,178,657 | 12/1979 | Way, Jr. | 16/229 |
| 4,455,711 | 6/1984 | Anderson | 16/262 |
| 4,482,023 | 11/1984 | Dziedzic et al. | 16/262 |
| 5,704,167 | 1/1998 | Swinderman . | |

FOREIGN PATENT DOCUMENTS

| | | | |
|---|---|---|---|
| 1338240 | 8/1963 | France | 16/386 |

*Primary Examiner*—Chuck Y. Mah
*Attorney, Agent, or Firm*—Needle & Rosenberg, P.C.

[57] ABSTRACT

A hinge assembly, which permits convenient assembly and disassembly by simple push operations, includes a first part to be secured to a body member and carrying a hinge pin, and a second part to be secured to a pivotal member and carrying a socket for pivotally receiving the hinge pin of the first part. The hinge pin is retractably mounted to the first part so as to be movable to an extended, operative position receivable within the socket of the second part for pivotally mounting the pivotal member to the base member, and to a retracted, released position spaced from the socket of the second part for permitting removal of the pivotal member from the body member. Also described is a cabinet with at least one such hinge assembly on each of the two opposite edges of the main cabinet section and cover section, respectively. One hinge assembly serves as a pivotal mounting of the cover section to the main cabinet section permitting the cover section to be pivoted to its open and closed positions with respect to the main cabinet section; and the other hinge assembly serves as a releasable latch for latching the cover section in its closed position with respect to the main cabinet section.

14 Claims, 4 Drawing Sheets

LATCHING HINGED COVER

FIELD AND BACKGROUND OF THE INVENTION

The present invention relates to hinge assemblies for pivotally mounting a pivotal member to a base member. The invention is particularly useful in cabinet structures for pivotally mounting a cover to the main cabinet section, and the invention is therefore described below with respect to this application.

Cabinets including a cover or panel pivotally mounted to a main cabinet section are widely used, among many other applications, in the electronics industry for housing the electronic components in a compact and readily-accessible manner for servicing purposes. Frequently, the cover is removed from the cabinet section to provide more convenient access to the components within the cabinet than would be allowed by the pivotal mounting. In the conventional cabinet structures now in use, the hinge assemblies pivotally mounting the cover to the main cabinet section are generally secured by screws or bolts, which must be removed for removing the cover and re-applied for re-attaching the cover. Both the removal operation and the re-attachment operation require the use of tools or considerable manual effort. While the need for tools, or such manual effort, to detach the cover from the main cabinet section generally would not deter the servicing personnel from detaching the cover in order to facilitate access to the components in the cabinet for servicing purposes, the need for such tools and/or manual effort, and the time require to re-apply the cover, do frequently deter the servicing personnel from re-attaching the cover to the main cabinet section, thereby leaving the main cabinet section uncovered. Failure to re-attach the cover section to the main cabinet section could create a hazardous situation with respect to the electrical components within the main cabinet section. Moreover, it could lead to the loss or misplacement of the cover when it is desired to reattach it to the main cabinet section.

OBJECTS AND BRIEF SUMMARY OF THE INVENTION

An object of the present invention is to provide a hinge assembly for pivotally mounting a pivotal member to a body member, which hinge assembly is particularly useful for cabinet structures to facilitate the reattachment of the cover to a main cabinet section in a quick and easy manner and without the need for tools or special manual effort. Another object of the present invention is to provide a cabinet including one or more such hinge assemblies for mounting a cover section to the main cabinet section in a manner which permits the cover section to be conveniently attached from and reattached to the main cabinet section without the need for tools or special manual effort.

According to a broad aspect of the present invention, there is provided a hinge assembly for pivotally mounting a pivotal member to a body member, the hinge assembly including: a first part to be secured to one of the members and carrying a hinge pin, and a second part to be secured to the other of the members and carrying a socket for pivotally receiving the hinge pin of the first part; characterized in that the hinge pin is retractably mounted to the first part so as to be movable to an extended, operative position receivable within the socket of the second part for pivotally mounting the pivotal member to the base member, and to a retracted, released position spaced from the socket of the second part for permitting removal of the pivotal member from the body member.

According to further features in the described preferred embodiment, the hinge pin is spring-urged to the extended, operative position, and is manually movable to the retracted, released position. In addition, the hinge pin includes an operator arm for manually moving the hinge pin to its retracted, released position.

According to more particular features in the described preferred embodiment, the first part carrying the hinge pin is formed with a slot formation receiving the operator arm and releasably holding the hinge pin in its extended operative position and retracted, released position, respectively. The slot formation includes a first section on one face of the first part for receiving the operator arm when the hinge pin is in extended operative position, joined to a second section on an adjacent face of the first part for receiving the operator arm when the hinge pin is in its retracted, released position.

According to still further features in the described preferred embodiment, the socket of the second part is in the form of a socket ring having a central opening for pivotally receiving the hinge pin of the first part. More particularly, the first part includes a first section telescopingly receiving the hinge pin, and a second section spaced below and aligned with the hinge pin of the first section to define a transverse slot between the first and second sections extending transversely of the hinge pin for receiving the socket ring of the second part when pivotally mounted to the first part. In addition, the outer tip of the hinge pin is tapered, and the edge of the socket ring facing the hinge pin, when the socket ring is to inserted into the transfirst slot, is also tapered, to facilitate the entry of the socket ring into the slot when pivotally mounting the first part to the second part.

According to another aspect of the present invention, there is provided a cabinet comprising a main cabinet section, and a cover section pivotally mounted to one edge of the main cabin section by at least one hinge assembly having the above-described features, whose two parts are secured to the main cabin section and to the cover section, respectively. In the described preferred embodiments, the cabinet includes at least one such hinge assembly on each of the two opposite edges of the main cabinet section and cover section, respectively, at least one hinge assembly serving as a pivotal mounting of the cover section to the main cabinet section permitting the cover section to be pivotted to its open and closed positions with respect to the main cabinet section, and at least one other hinge assembly serving as a releasable latch for latching the cover section in its closed position with respect to the main cabinet section.

In one described embodiment, there are two such hinge assemblies on one edge of the main cabinet section and cover section, spaced apart to pivotally mount the cover section to the main cabinet section, and a third hinge assembly on this opposite edge of the main cabinet section and cover section for latching the cover section in its closed position with respect to the main cabinet section.

In a second described embodiment, there are two such hinge assemblies on the one edge of the main cabinet section and cover section, and another two such hinge assemblies on the opposite edge of the main cabinet section and cover edge of the cover section to be pivotally attached to, or to be detached from, the main cabinet section.

Further features and disadvantages of the invention will be apparent from the description below.

BRIEF DESCRIPTION OF THE DRAWINGS

The invention is herein described, by way of example only, with reference to the accompanied drawings, wherein.

DESCRIPTION OF A PREFERRED EMBODIMENT

Figure 1:
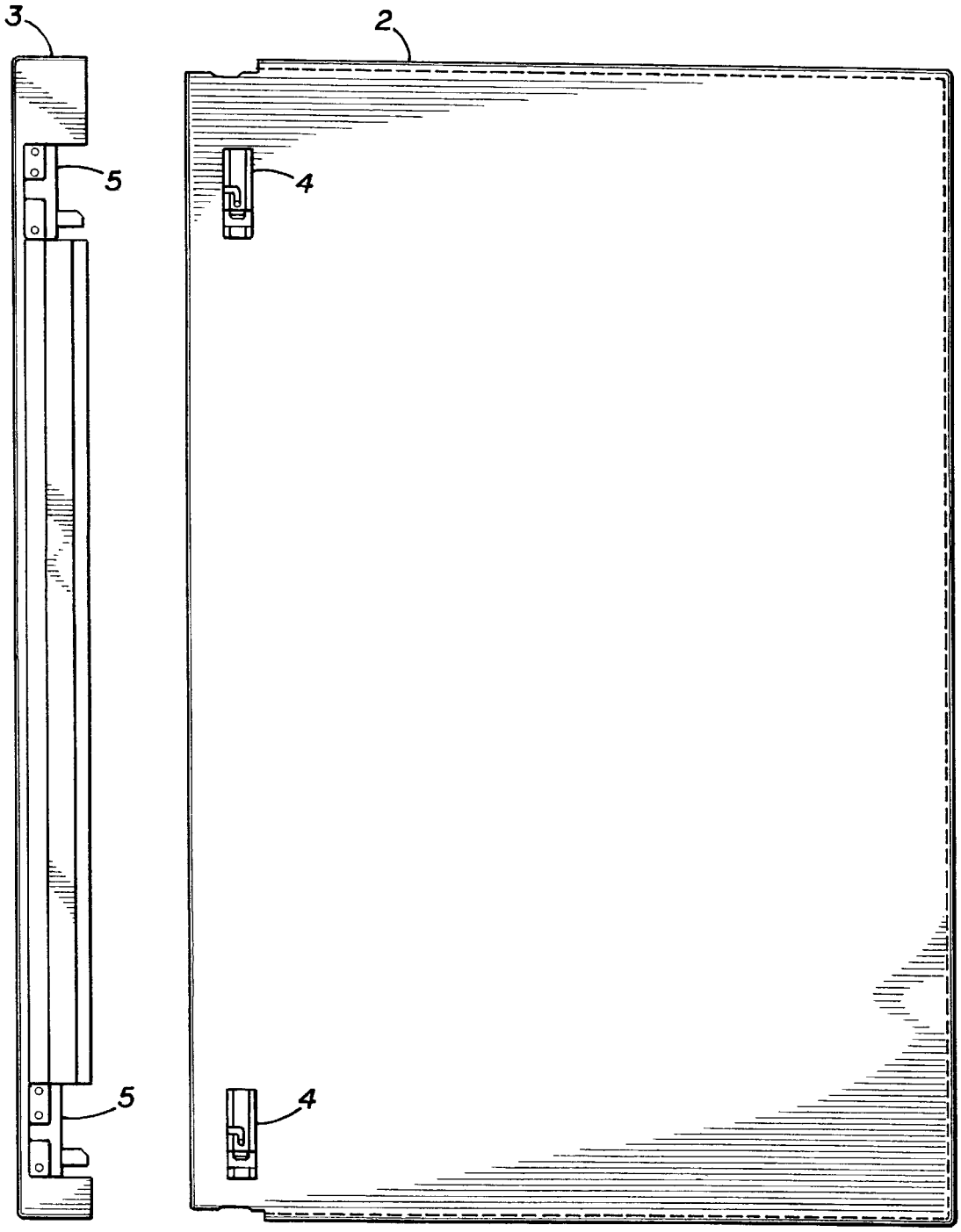
FIG. 1 is a side view illustrating a main cabinet section and cover section carrying the respective parts of one form of hinge assembly constructed in accordance with the present invention to enable the cover section to be either pivotally mounted to, or detached from the main cabinet section in a convenient and quick manner; and without the need for tools or special manual effort.

With reference to FIG. 1, there is illustrated a cabinet constituted of a main cabinet section 2 and a cover section 3, which may be either pivotally mounted to the main cabinet section 2, or detached from it, in a quick and convenient manner without the need for tools or screws, bolts or other fastening elements. For this purpose, a hinge assembly is used constructed in accordance with the present invention, as described particularly below, which hinge assembly includes a first part, generally designated 4, secured to the main cabinet section 2, and a second part, generally designated 5, which is secured to the cover section 3. In the example illustrated in FIGS. 1 and 2, the cabinet includes three such hinge assembles, two located at the ends of one edge of the cabinet, and a third located centrally of the opposite edge, as shown particularly in FIG. 2. In such an arrangement, the two hinge assemblies serve to pivotally mount the cover section 3 to the main cabinet section 2, and the third hinge assembly serves to releaseably latch the cover section in a closed position in respect of the main cabinet section.

Figure 3:
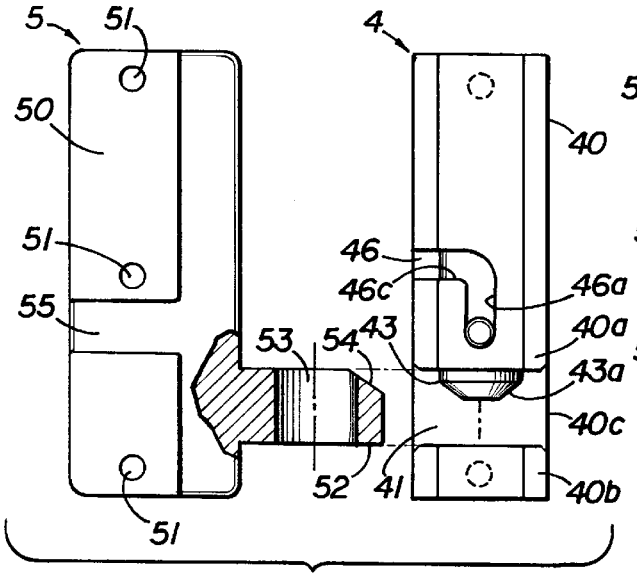
FIG. 3 is an exploded view illustrating the two parts of each hinge assembly in FIG. 1 and FIG. 2.
Figure 4:
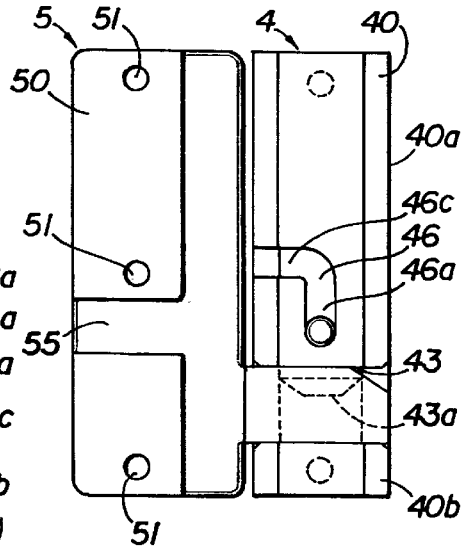
FIG. 4 is a view illustrating the two parts of the hinge assembly of FIG. 3 in an assembled condition.

FIGS. 3 and 4 more particularly illustrate the structure of part 4 of the hinge assembly attached to the main cabinet section 2, and part 5 attached to the cover section 3. These two parts are shown in the exploded condition in FIG. 3, and in the assembled condition in FIGS. 4, 5*a* and FIG. 5*b*.

Figure 5A:
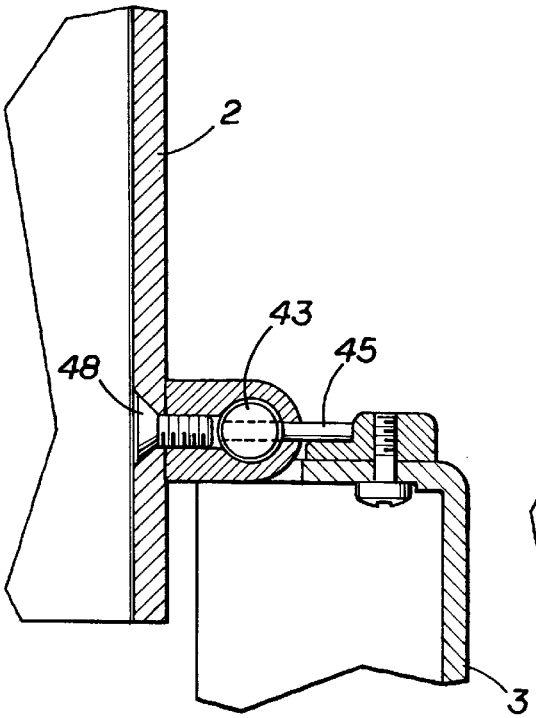
FIGS. 5*a* and 5*b* are top plan views illustrating the two parts of the hinge assembly in an assembled condition in the cover-open and cover-closed positions, respectively.
Figure 5B:
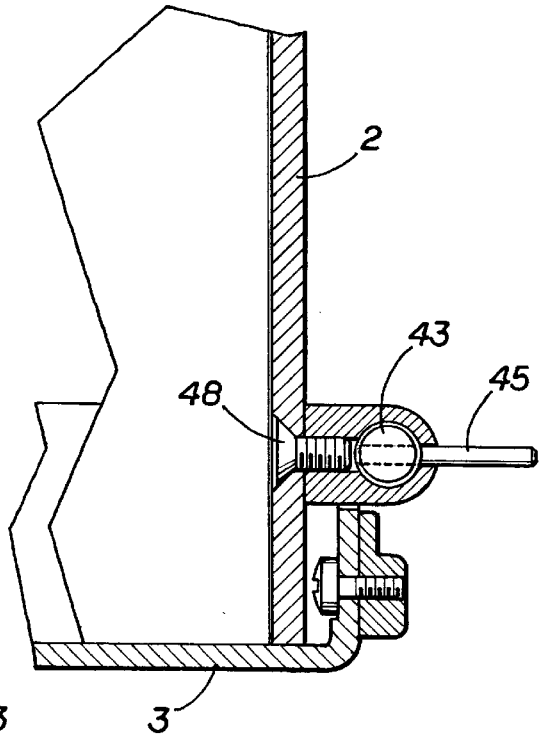
Figure 6:
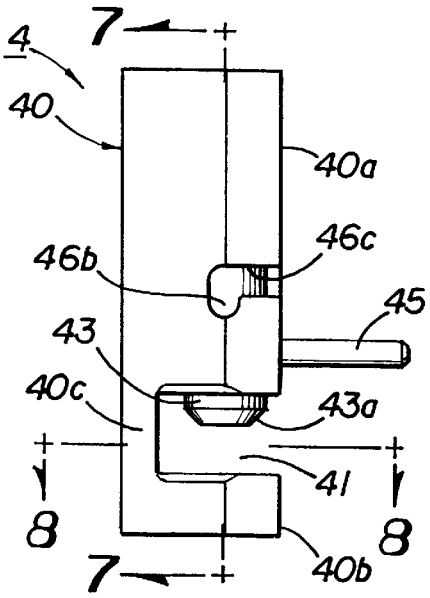
FIG. 6 is a side view illustrating the part of the hinge assembly attached to the main cabinet section.
Figure 7:
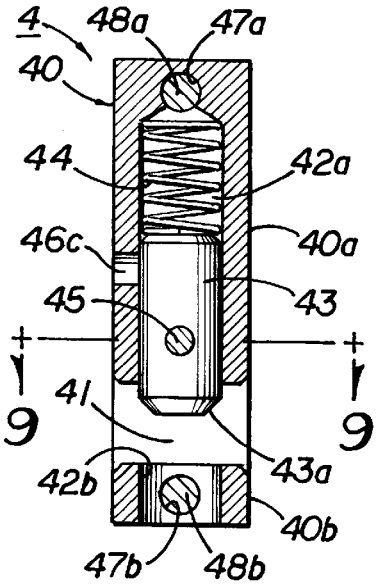
FIG. 7 and FIG. 8 are sectional views along lines 7—7 and 8—8 of FIG. 6.
Figure 8:
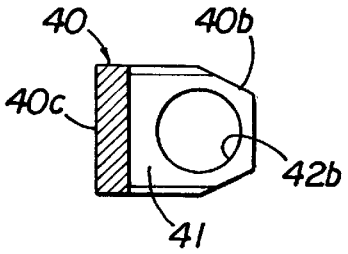
Figure 9:
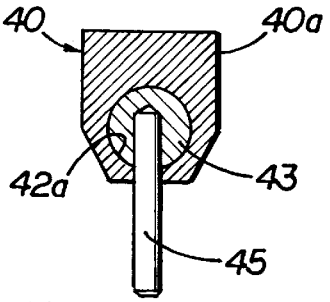
FIG. 9 is a sectional view along line 9—9 of FIG. 7.

As shown in FIGS. 4, 5*a* and 5*b*, and also in FIGS. 6–9, hinged part 4 secured to the main cabinet section 2 includes a body member, generally designated 40, constituted of a main section 40*a* and a depending section 40*b* connected to section 40*a* by a juncture 40*c* (FIG. 6) to define a transversely extending slot 41 between the two sections. The two sections 40*a*, 40*b* are formed with a longitudinal bore 42*a*, 42*b*, respectively (FIG. 7). Bore 42*a* terminates short of the end of body member 40 opposite to that facing away from section 40*b*. A pin 43 is disposed within bore section 42*a* and is urged towards body member section 40*b* by a coiled spring 44. An arm 45 is secured to pin 43 and extends outwardly of body section member 40*a* within a slot formation, generally designated 46. Slot formation 46 includes a first section 46*a* on the front face of body member section 40*a* (FIG. 4) joined to a second slot section 46*b* (FIG. 6) on the adjacent side face of body member section 40*a* by means of a connecting slot section 46*c*.

As will be described more particularly below, pin 43, telescopingly received within body member section 40*a*, is normally urged to an extended, operative position shown in FIGS. 4 and 6 by spring 44, which position is defined by engagement of arm 45 against the end of slot section 46*a*. In this extended, operative position of the pin, it is receivable within a socket of hinge part 5 secured to the cover section 3 for pivotally mounting the cover section to the main cabinet section 2. However, pin 43 may be manually moved to a retracted, released position by grasping arm 45 and moving the pin against the spring 44, to lift the lower end of the pin from the socket of hinge part 5 secured to the cover section 3, and thereby to permit the removal of the cover section from the main cabinet section 2. Pin 43 is retained in its retracted, released position, when moved thereto, by slot section 46*b* receiving arm 45.

Body member 40 is found with a pair of threaded holes 47*a*, 47*b* (FIG. 7) at its opposite ends for receiving bolts, 48*a*, 48*b*, to secure body member 4 of the hinge assembly to the main cabinet section 2.

Hinge part 5 secured to the cover section 3 is constituted of a generally flat plate 50 (FIGS. 3,4) formed with threaded holes 51 for securing the hinge part to the cover section 3. Hinge part 5 further includes the previously-mentioned socket member 52 (FIG. 3) in the form of a ring dimensioned to be received within the transversely-extending slot 41 of hinge part 4 when the two hinged parts are pivotally coupled together. Socket ring 52 is formed with an opening 53 of approximately the same diameter as, and aligned with, the bore section 42*a* of body member 40 for receiving the tip of pin 43.

The outer tip of hinge pin 43 is tapered, as shown at 43*a*. In addition, the edge of the socket ring 52 facing the hinge pin 43 when socket ring is inserted into the transverse slot 41, is also tapered, as shown at 54 (FIG. 3) to facilitate the entry of the socket ring into the slot when pivotally mounting hinge part 5 secured to the cover section 3, to hinge part 4 secured to the main cabinet section 2.

The mounting plate 50 is further formed with a transverse recess 55 to accommodate arm 45 of hinge part 4 when the two hinge parts 4 and 5 are pivotted to the open position of cover section 3 with respect to the main cabinet section 2, as shown in FIG. 5*a*.

Figure 2:
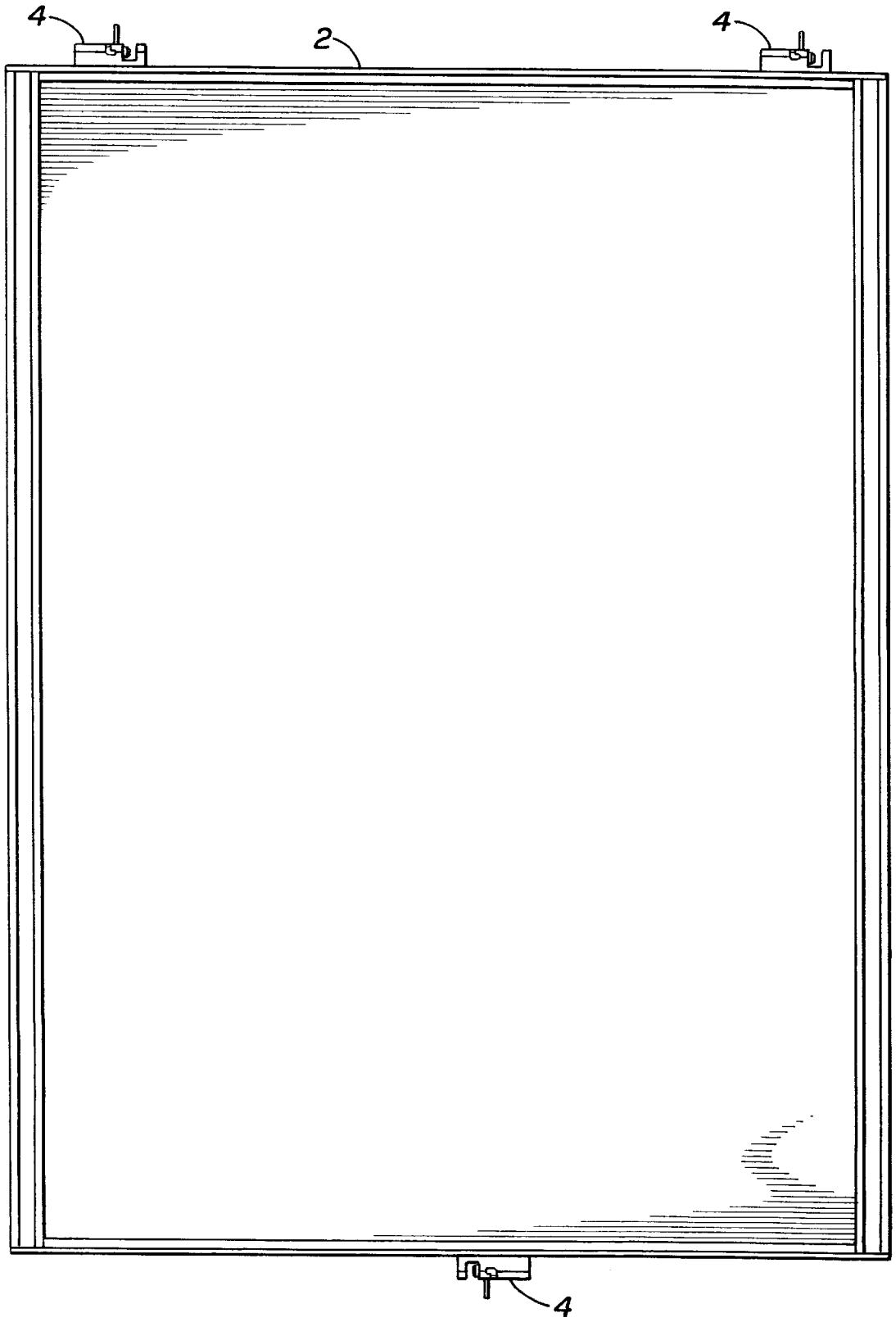
FIG. 2 is a front view of the cabinet of FIG. 1 and illustrates the parts of each hinge assembly attached to the main cabinet section.

The cabinet illustrated in FIGS. 1 and 2 includes three hinge assemblies, each constructed as described above with a hinge part 4 secured to the main cabin section 2, and a hinge part 5 secured to the cover section 3. All three hinge assemblies illustrated in FIGS. 1 and 2 are of identical construction and operate in the same manner, as follows:

Pin 43 of hinge part 4 is normally in its extended, operative position, slightly penetrating into the transverse slot 41 under the urging of spring 44, as limited by the engagement of arm 45 with the end of section 46*a* of slot formation 46.

The cover section 3 is pushed to insert socket ring 52 of hinge part 5 into the transverse slot 41 of hinge part 4. This is facilitated by the tapered edge 54 of socket ring 52 facing the transverse slot 41, and tapered tip 43*a* of pin 43 engaged by the tapered edge 54 of the ring to move the pin against the spring 44 when the socket ring is pushed into the transverse slot 41. As soon as this insertion has been completed, pin 43 returns, under the action of spring 44, to its extended, operative position seated within the upper part of the socket ring 52, thereby pivotally mounting the socket ring, and the cover section 3 to which it is secured, with respect to hinge pin 43 and the main cabinet section 2 to which it is secured.

When it is desired to detach the two hinge parts, this can be done in a quick and convenient manner, by manually engaging arm 45 and moving it, together with pin 43, to the opposite end of section 46*a* of slot formation 46, and then moving the arm, via the juncture section 46*c* into the locking section 46*b*, for releasably retaining the arm, and thereby the hinge pin 43, in the retracted, released position of the hinge pin spaced from the socket ring 52.

When the socket ring 52 has thus been detached from the hinge pin 43, the two parts may be easily separated. If it is desired to retain the hinge pin in its retracted, released position, this may easily be done by retaining arm 45 in section 46*b* (FIG. 6) of the slot formation. Whenever it is ever desired to reattach hinge part 5, and the cover section 3 to which it is secured, to hinge part 4 in the main cabinet section 2 to which that part is secured, arm 45 is moved into section 46*a* of slot formation 46 such that pin 43 of hinge part 4 can receive socket ring 52 of hinge part 5 by a simple push movement in the manner described above.

FIG. 5*a* illustrates the cover section 3, and hinge part 5 secured to it, in the open position of the cover section; where FIG. 5*b* illustrates the cover section and hinge part 5 in the closed position of the cover section.

It will thus be seen that each hinge assembly, including the two hinge parts 4 and 5, permit the pivotal mounting of the two hinge parts together, or the detachment of one hinge part with respect to the other. Accordingly, each hinge assembly may be used as a conventional hinge and also as a releasable latch.

In the cabinet construction illustrated in FIGS. 1 and 2, there are two such hinge assemblies at opposite ends of one edge of the main cabinet section 2 and the corresponding edge of the cover section 3, and a third hinge assembly located centrally on the opposite edge of the cover and main cabinet sections. In this construction, the two hinge assemblies at one edge serve as a pivotal mounting of the cover section to the main cabinet section, whereas the single hinge assembly located centrally on the opposite edge serves as a releasable latch for latching the cover section in its dosed position with respect to the main cabinet section. In such a construction, the cover section may be pivotally mounted at one edge and latched at the opposite edge, or completely detached from both edges and re-attached to both edges, all in a simple and quick manner as described above, and without the need for tools.

Figure 10:
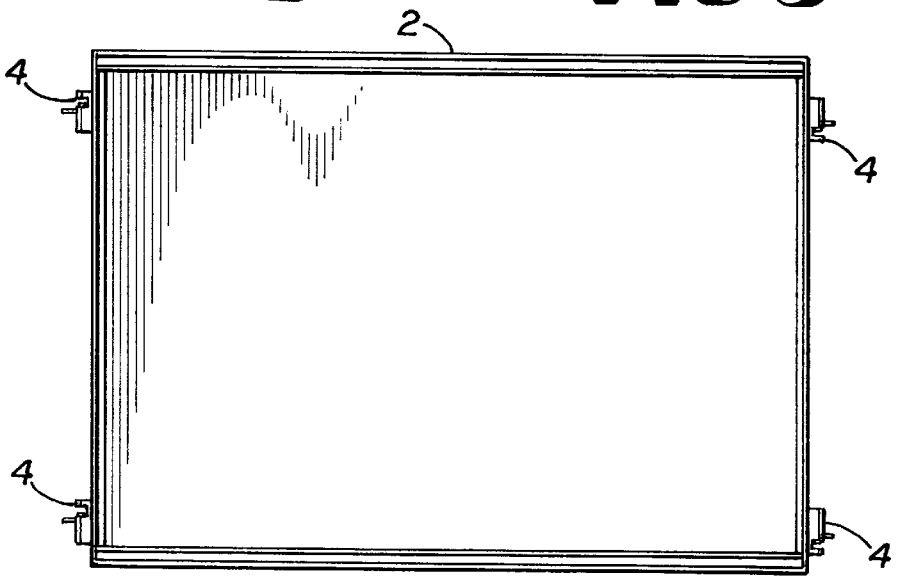
FIG. 10 view is similar to that of FIG. 2 but illustrating the provision of four hinge assemblies, two on each edge, to permit pivoting the cover section from either side of the main cabinet section.

FIG. 10 illustrates another arrangement wherein there are two of the above-described hinge assemblies on opposite ends of each of the two opposite sides of the main cabinet section and cover section. Such an arrangement, also permits the cover section to be completely detached from, or reattached to the main cabinet section by simple push-fitting operations, but provides the further advantage of permitting the cover section to be pivotally mounted to either side of the main cabinet section.

While the invention has been described with respect to a preferred embodiment, it will be appreciated that this is set forth mainly for purposes of example, and that the invention could also be applied in many other applications. For example, the novel hinge assembly could be used for pivotally and removably mounting a shelf to a wall, or a door to a door frame. Many other variations, modifications and applications of the invention will be apparent to those skilled in the art.

What is claimed is:

1. A hinge assembly for pivotally mounting a pivotal member to a body member, said hinge assembly including: a first part to be secured to one of said members and carrying a hinge pin, and a second part to be secured to the other of said members and carrying a socket for pivotally receiving the hinge pin of the first part; characterized in that said hinge pin is retractably mounted to said first part so as to be movable to an extended, operative position receivable within said socket of the second part for pivotally mounting the pivotal member to the base member, and to a retracted, released position spaced from said socket of the second part for permitting removal of the pivotal member from the body member, wherein said first part of said hinge assembly includes a first section telescopingly receiving said hinge pin, and a second section spaced below and aligned with said first section to define a transverse slot between the first and second sections extending transversely of the hinge pin for receiving said socket of the second part when pivotally mounted to said first part.

2. The hinge assembly according to claim 1, wherein said hinge pin is spring-urged to said extended, operative position, and is manually movable to said retracted, released position.

3. The hinge assembly according to claim 2, wherein said hinge pin includes an operator arm for manually moving the hinge pin to its retracted, released position.

4. The hinge assembly according to claim 3, wherein said first part carrying the hinge pin is formed with a slot formation receiving said operator arm and releaseably holding said hinge pin in its extended, operative position and retracted, released position, respectively.

5. The hinge assembly according to claim 4, wherein said slot formation includes a first section on one face of the first part for receiving said operator arm when the hinge pin is in its extended, operative position, said first section of the slot formation being joined to a second section on an adjacent face of the first part for receiving said operator arm when the hinge pin is in its retracted, released position.

6. The hinge assembly according to claim 5, wherein said second part is formed with a recess for receiving said operator arm in the pivoted position of said second part with respect to said first part.

7. The hinge assembly according to claim 1, wherein said socket of the second part is in the form of a socket ring having a central opening for pivotally receiving said hinge pin of the first part.

8. The hinge assembly according to claim 7, wherein the perimeter of the outer tip of the hinge pin is tapered, and the edge of the socket ring facing the hinge pin, when the socket ring is to be inserted into said transverse slot, is also tapered, to facilitate the entry of the said socket ring into said transverse slot when pivotally mounting the first part to said second part.

9. A cabinet comprising a main cabinet section, and a cover section pivotally mounted to one edge of said main cabin section by at least one hinge assembly according to claim 1, whose two parts are secured to the main cabin section and to said cover section, respectively.

10. The cabinet according to claim 9, when the cabinet includes at least one said hinge assembly on each of the two opposite edges of the main cabinet section and cover section, respectively, at least one hinge assembly serving as a pivotal mounting of the cover section to the main cabinet section permitting the cover section to be pivotted to its open and closed positions with respect to the main cabinet section, and at least one other of said at least one said hinge assembly serving as a releasable latch for latching the cover section in its closed position with respect to the main cabinet section.

11. The cabinet according to claim 10, wherein said at least one said hinge assembly comprises two of said hinge assemblies on said one edge of the main cabinet section and cover section spaced apart to pivotally mount said cover section to the main cabinet section, and wherein said at least one said hinge assembly further comprises a third hinge assembly on the opposite edge of the main cabinet section and cover section located centrally of said opposite edge for latching said cover section in its closed position with respect to said main cabinet section.

12. The cabinet according to claim 10 wherein said at least one said hinge assembly comprises two of said hinge assemblies on said one edge of the main cabinet section and cover section, and wherein said at least one said hinge assembly further comprises another two of said hinge assemblies on said opposite edge of the main cabinet section and cover section, to permit either edge of the cover section to be pivotally attached to, or to be detached from, the main cabinet section.

13. A hinge assembly for pivotally mounting a pivotal member to a body, member comprising:

a first part to be secured to one of said members and carrying a hinge pin and including a first section telescopingly receiving said hinge pin, and a second section spaced below and aligned with the first section to define a transverse slot between the first and second sections extending transversely of said hinge pin; and a second part to be secured to the other of said members and carrying a socket for pivotally receiving the hinge pin of the first part said transverse slot for receiving said socket of said second part when pivotally mounted to said first part, said hinge pin being retractable mounted to said first part so as to be movable to an extended, operative position within said socket of the second part for pivotally mounting the pivotal member to the body member, and to a retracted, released position spaced from said socket of the second part for permitting removal of the pivotal member from the body member, said first part further including a coiled spring urging said hinge pin to its extended, operative position so as to permit the pivotal member to be pivotally mounted to the base member by merely inserting the socket of the second part into and in engagement with the hinged pin of the first part.

14. The hinge assembly according to claim 13, wherein the perimeter of the outer tip of the hinge pin is tapered, and the edge of the socket facing the hinge pin, when the socket is to be inserted into said transverse slot, is also tapered, to facilitate the entry of the said socket into said transverse slot when pivotally mounting the first part to said second part.

* * * * *